US006205628B1

(12) United States Patent
Downie

(10) Patent No.: US 6,205,628 B1
(45) Date of Patent: Mar. 27, 2001

(54) BUCKLE

(75) Inventor: Andrew John Downie, Carlisle (GB)

(73) Assignee: Breed Automotive Technology, Inc., Lakeland, FL (US)

( * ) Notice: Subject to any disclaimer, the term of this patent is extended or adjusted under 35 U.S.C. 154(b) by 0 days.

(21) Appl. No.: 09/341,624

(22) PCT Filed: Feb. 16, 1998

(86) PCT No.: PCT/GB98/00476

§ 371 Date: Jul. 14, 1999

§ 102(e) Date: Jul. 14, 1999

(87) PCT Pub. No.: WO98/38882

PCT Pub. Date: Sep. 11, 1998

(30) Foreign Application Priority Data

Feb. 17, 1997 (GB) ..... 9703219

(51) Int. Cl.[7] ..... A44B 11/25
(52) U.S. Cl. ..... 24/633; 24/637
(58) Field of Search ..... 24/633, 642, 652, 24/639, 640

(56) References Cited

U.S. PATENT DOCUMENTS 4,766,654 * 8/1988 Sugimoto ..... 24/637
5,496,068 * 3/1996 Ball et al. ..... 24/633

FOREIGN PATENT DOCUMENTS

4401291 * 11/1995 (DE) .
0368277 * 5/1990 (EP) .
0384703 * 8/1990 (EP) .
0679348 * 11/1995 (EP) .
2145766 * 4/1985 (GB) ..... 24/633
2173243 * 10/1986 (GB) ..... 24/633
2289308 * 11/1995 (GB) .

* cited by examiner

*Primary Examiner*—Victor N. Sakran
(74) *Attorney, Agent, or Firm*—Markell Seitzman

(57) ABSTRACT

The buckle of the invention comprises a housing, a buckle part connected to one end of a seat belt and having a passage for receiving an interlocking tongue part connected to another end of a seat belt, a pivoting carrier element carrying a latching element arranged to engage with the tongue part to lock the tongue part in the passage, a release button operatively coupled via a ramp surface to move the latching element from an engaging position in which the buckle is fastened to the tongue, to a release position in which the buckle is unfastened, a counterbalance mass slidably mounted in the housing so that its inertia acts on the latching element to keep the latching element in the tongue engaging position under forces of acceleration and of deceleration acting on the buckle, the inertia acting in a first direction under acceleration and in a second direction under deceleration thereby substantially to counteract the effects of button inertia on the operation of the buckle. This arrangement provides a buckle restraint to spurious release even under high pretensioning forces.

9 Claims, 5 Drawing Sheets

BUCKLE

DESCRIPTION

The present invention relates to a buckle for a vehicle safety restraint seat belt. The invention particularly relates to a buckle which is resistant to spurious opening when subjected to the high acceleration forces incident in a crash situation and particularly to the high acceleration forces generated in a crash situation when a pretensioner is fitted to a seat belt at the buckle end.

Pretensioners are used in modern safety restraints to rapidly take up any slack in the seat belt to more securely hold a vehicle occupant in the seat and to more correctly position him, for example for optimum effect of a passive protection device such as an airbag. They operate in the first milliseconds of a crash, before the impact forces come into full effect and when they operate at the buckle end of the belt they subject the buckle to extremely high g-forces. Traditional buckles tend to come unlatched at the end of the pretensioning stroke as a result of the inertia of the buckle release button which causes it to keep moving in the release direction after the fixed buckle parts have been halted. Instances of spurious release can also occur as the pretensioner comes into effect due to the high acceleration g-forces.

Known ways of reducing the effect of the g-forces include either preventing release by blocking the moving parts in a buckle or introducing balancing masses into the buckle mechanism to counteract the effects of the g-forces on the moving parts of the buckle. However known mechanisms do not always work satisfactorily, especially at the high forces required to satisfy modern safety standards.

It is an object of the present invention to provide an improved g-proof buckle for use with a buckle pretensioner.

According to the present invention there is provided a buckle for a vehicle safety restraint seat belt comprising:

- a housing,
- a buckling part connected to one end of a seat belt and having a passage for receiving an interlocking tongue part connected to another end of a seat belt,
- a pivoting carrier element carrying a latching element arranged to engage with the tongue part to lock the tongue part in the passage,
- a release button operatively coupled via a ramp surface to move the latching element from an engaging position in which the buckle is fastened to the tongue, to a release position in which the buckle is unfastened,
- a counterbalance mass slidably mounted in the housing so that its inertia acts on the latching element to keep the latching element in the tongue engaging position under forces of acceleration and of deceleration acting on the buckle, the inertia acting in a first direction under acceleration and in a second direction under deceleration thereby substantially to counteract the effects of button inertia on the operation of the buckle.

Preferably the counterbalance mass is resiliently connected to the release button, and even more preferably comprises a slidably mounted spring carrier having a boss for one end of the button return spring. The spring carrier may be formed with channels which engage support brackets riveted to the buckle frame or housing so as to constrain the spring carrier against pivotal movement.

Preferably the carrier element is pivotally attached with respect to the buckle housing.

For a better understanding of the present invention and to show how the same may be carried into effect, reference will now be made to the accompanying drawings in which.

Figure 1:
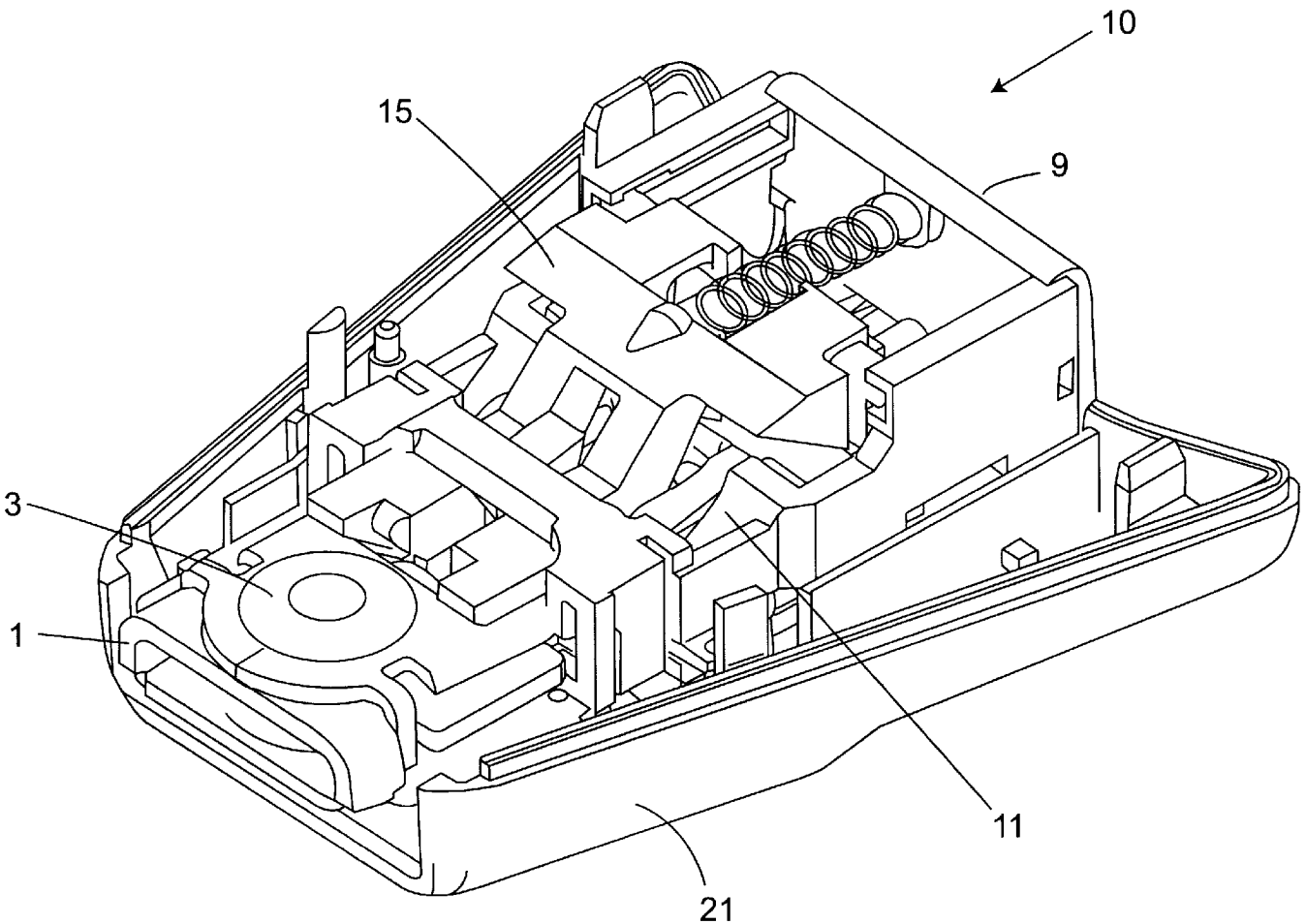
FIG. 1 shows a perspective top view of a buckle according to the invention, with the top cover removed.
Figures 2, 2A:
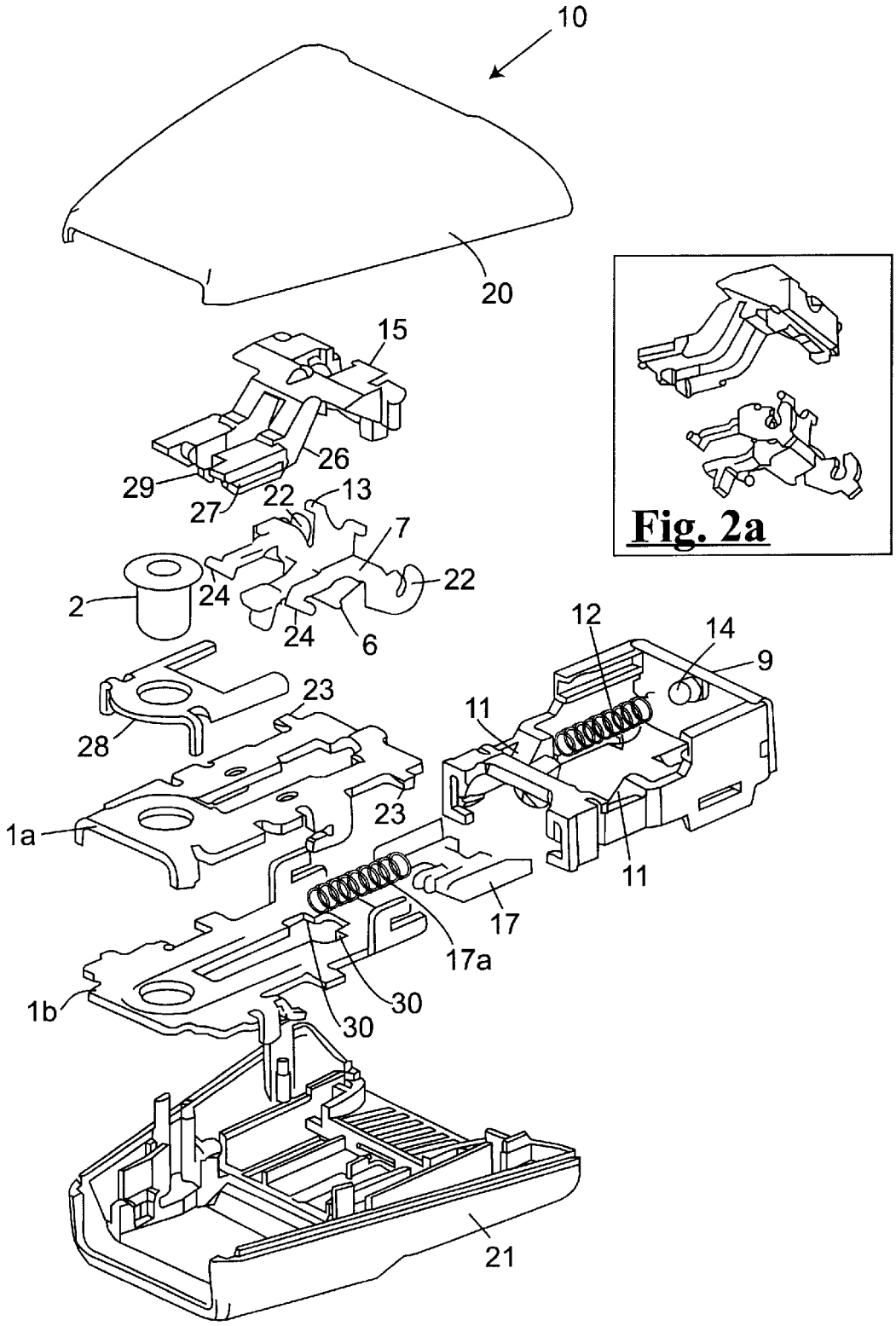
FIG. 2 shows an exploded view of the buckle of FIG. 1 generally viewed from above.
Figure 3:
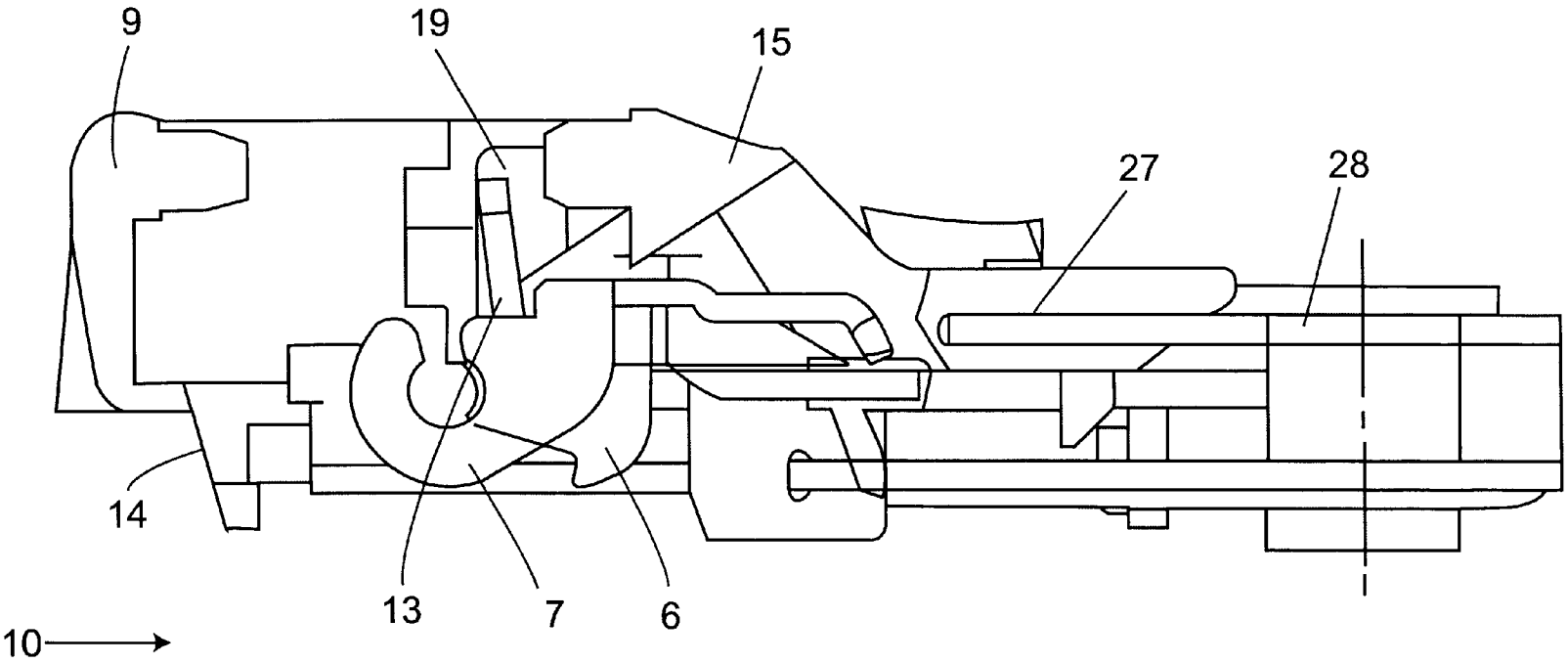
Figure 4:
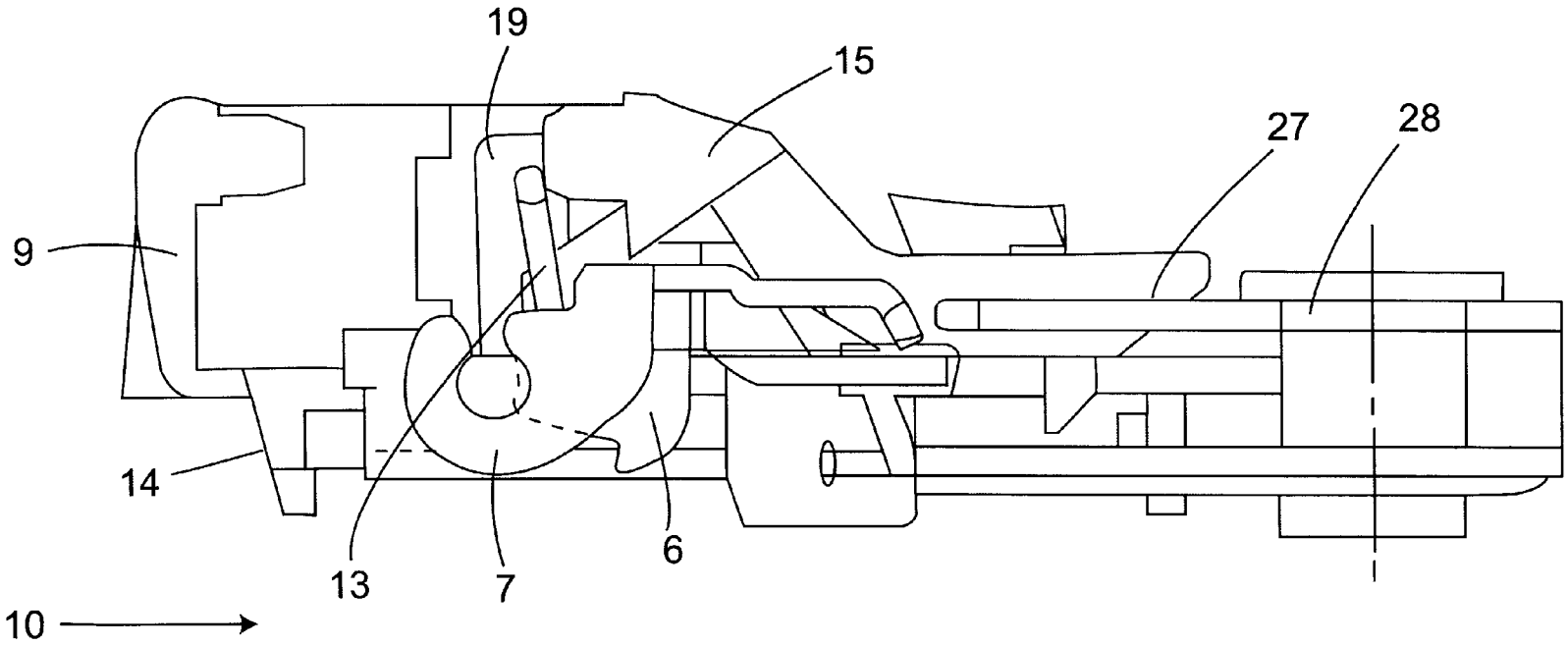
Figure 5:
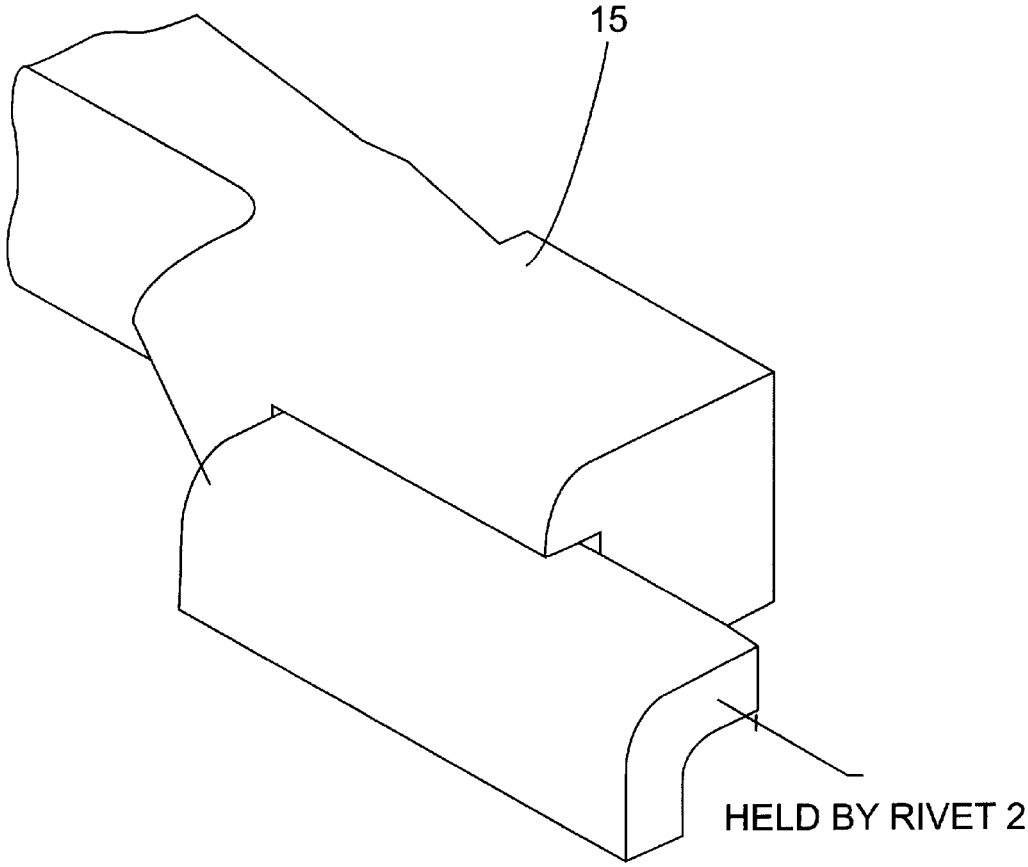

FIG. 2*a* shows part of FIG. 2 generally viewed from below;

FIG. 3 shows a cross-sectional view of the buckle of FIG. 1 in the carrier back position;

FIG. 4 shows a cross-sectional view of the buckle of FIG. 1 in the carrier forward position;

FIG. 5 is a close-up view of part of the buckle of FIG. 1.

In the Figures there is shown a buckle housing 1 attached to safety belt webbing (not shown) by a rivet 3 The housing 1 has a passage (FIGS. 4 and 5) 4 to receive a locking tongue (not shown) which is attached to another length of belt webbing (not shown). The locking tongue is held in the passage 4 by a latching element or lockbar 6 which is carried by a carrier member 7.

Unlatching of the buckle is achieved by depressing a sliding button 9 in the direction of arrow 10 (which corresponds to the direction in which the buckle is pulled rapidly during pretensioning, ie to the acceleration direction at the beginning of the pretensioning stroke). At the end of the pretensioning stroke the buckle comes to an abrupt halt and is thus subjected to a high force corresponding to the deceleration direction opposite to the arrow 10.

The button 9 is operatively connected to, or incorporates a ramp member 11 which serves to lift the carrier member 7 and lockbar 6 out of the engagement position by pivoting them in as the button is depressed.

The carrier member 7 has an upwardly extending arm 13. A button return spring 12 is attached at one end to a boss 14 on the button 9 and at the other end to a boss on a spring carrier 15 which forms an inertia member or counterbalance mass. The button return spring 12 serves to bias the lockbar 6 into engagement with the tongue. Upper and lower buckle covers 20 and 21 clip together over the internal parts to prevent ingress of dirt and dust.

When the tongue is released it is pushed out of the passage 4 by an ejector 17 and ejector spring 17*a*.

The spring carrier 15 is formed with a cut away portion 19 which receives the upwardly extending arm 13 of the carrier 7 and by which the inertia of the spring carrier is transferred to the arm and thus to the carrier and lockbar to bias the lockbar into the engagement position and resist buckle release movement under conditions of high g-forces in the direction 10.

When a tongue is inserted into the buckle along passage 14 it contacts the ejector 17 in its forward position and moves it backwards against the ejector spring 17*a*. At a predetermined position, the ejector 17 contacts the spring carrier 15 and both continue to move backwards together. This movement also engages the carrier assembly 7 at its vertical lever arm 13 and rotates the carrier assembly 7, down a button cam face into engagement. The cam face on the button 9 allows an overlocker to be repositioned over the carrier assembly 7 in its rest position using the force applied by the button spring 12.

The button movement to release the tongue is in the direction of arrow 10 and initially removes the overlock from the carrier assembly 7. Movement continues until the button ramps 11 contact and rotate the carrier assembly 7 by acting on forward arms 24 to turn pivot arms 22 on the carrier assembly 7 about pivot tubs 23 on the frame 1. This movement of the carrier assembly 8 also engages the spring carrier 15 at its contact point with the carrier assembly's vertical lever arm 13 and slides the spring carrier forward.

Movement of the carrier assembly 7 continues up the button ramp 11 until it reaches the top of the ramp. At this point, when the tongue is in a release position, the forward button cam contacts the carrier assembly 7, rotating it to allow full forward movement of the tongue and ejector under the force of the ejector spring.

During the acceleration phase (buckle housing moving in direction 10) the spring carrier 15 and its combined ramp 26 slide into the forward position of FIG. 4 against the force of the button spring 12 into a position where the spring carrier ramp 26 transfers inertia to the carrier assembly 7 at its lower release lever arm 24. The spring carrier's inertia forces bias the carrier assembly into engagement and it is prevented from rotating by the inertia of the spring carrier held in the support bracket (FIG. 5). No delatching forces are applied to the carrier assembly 7 by the spring carrier.

During deceleration (buckle housing stopped abruptly) the spring carrier 15 slides from its acceleration position into the back position of FIG. 3 and contacts with the carrier assembly 7 at its vertical lever arm 13. The spring carrier's inertia force biases the carrier assembly into engagement and the carrier lockbar assembly is prevented from rotating by the inertia of the spring carrier 15. The contact forces with this lever arm are uniformly distributed over the length of the support bracket. Because of the geometry of the design the moment applied by the spring carrier to the carrier assembly is approximately 25% greater than that applied by the button. Hooks 29 on the spring carrier 15 engage part of the housing (shoulders 30 on 1*b*).

The support bracket holding the spring carrier in a sliding motion is shown in FIG. 5 where the elongate recesses 27 in the spring carrier 15 are engaged by a spring carrier support bracket 28. Bracket 28 is held in the buckle housing by rivet 2.

The spring carrier 15 arranged to be significantly heavier than the button and thus biases the carrier assembly 7 and the lockbar 6 into its tongue engaging position on deceleration.

This buckle has an increased performance ceiling compared to known buckles. This new buckle is a totally balanced system and does not rely on sensing or blocking. It is therefore more reliable and less prone to wear and fatigue failure since under normal conditions counterweight parts do not move.

What is claimed is:

1. A buckle for a vehicle safety restraint seat belt comprising:

a housing, a buckle part connected to one end of a seat belt and having a passage for receiving an interlocking tongue part connected to another end of a seat belt, a pivoting carrier element carrying a latching element arranged to engage with the tongue part to lock the tongue part in the passage, a release button operatively coupled via a ramp surface to move the latching element from an engaging position in which the buckle is fastened to the tongue, to a release position in which the buckle is unfastened, a counterbalance mass slidably mounted in the housing so that its inertia acts on the latching element to keep the latching element in the tongue engaging position under forces of acceleration and of deceleration acting on the buckle, the inertia acting in a first direction under acceleration and in a second direction under deceleration thereby substantially counteracting the effects of button inertia on the operation of the buckle.

2. A buckle according to claim 1 wherein the counterbalance mass is resiliently connected to the release button.

3. A buckle according to claim 1 wherein the carrier element is pivotally attached with respect to the buckle housing.

4. A buckle for a vehicle safety restraint seat belt comprising:

a housing, a buckle part connected to one end of a seat belt and having a passage for receiving an interlocking tongue part connected to another end of a seat belt, a pivoting carrier element carrying a latching element arranged to engage with the tongue part to lock the tongue part in the passage, a release button operatively coupled via a ramp surface to move the latching element from an engaging position in which the buckle is fastened to the tongue, to a release position in which the buckle is unfastened, a counterbalance mass slidably mounted in the housing so that its inertia acts on the latching element to keep the latching element in the tongue engaging position under forces of acceleration and of deceleration acting on the buckle, the inertia acting in a first direction under acceleration and in a second direction under deceleration thereby substantially counteracting the effects of button inertia on the operation of the buckle;

wherein the counterbalance mass comprises a slidably mounted spring carrier having a boss carrying one end of a button return spring.

5. A buckle according to claim 4 wherein the spring carrier is formed with channels which engage support brackets attached to the buckle housing so as to constrain the spring carrier against pivotal movement.

6. A buckle according to claim 5 wherein the spring carrier is riveted to the buckle housing.

7. A buckle according to claim 4 wherein the carrier element is pivotally attached with respect to the buckle housing.

8. A buckle according to claim 4 wherein the counterbalance mass is resiliently connected to the release button.

9. A buckle for a vehicle safety restraint seat belt comprising:

a housing, a buckle part connected to one end of a seat belt and having a passage for receiving an interlocking tongue part connected to another end of a seat belt, a pivoting latching element arranged to engage with the tongue part to lock the tongue part in the passage, a release button operatively coupled via a ramp surface to move the latching element from an engaging position in which the buckle is fastened to the tongue, to a release position in which the buckle is unfastened, a counterbalance mass slidably mounted in the housing so that its inertia acts on the latching element to keep the latching element in the tongue engaging position under forces of acceleration and of deceleration acting on the buckle, the inertia acting in a first direction under acceleration and in a second direction under deceleration thereby substantially counteracting the effects of button inertia on the operation of the buckle.

* * * * *